US005697355A

United States Patent [19]

Schaffer

[11] Patent Number: 5,697,355

[45] Date of Patent: Dec. 16, 1997

[54] CABLE ADJUSTER AND LIMB POCKET ASSEMBLY FOR COMPOUND BOW

[76] Inventor: John P. Schaffer, 3532 Spring Brook Way #5, La Crosse, Wis. 54601

[21] Appl. No.: 353,779

[22] Filed: Dec. 12, 1994

[51] Int. Cl.[6] ..... F41B 5/10

[52] U.S. Cl. ..... 124/25.6; 124/86

[58] Field of Search ..... 403/362; 24/129 A, 24/135 R, 135 A, 135 N, 136 B; 124/23.1, 25.6, 86, 88

[56] References Cited

U.S. PATENT DOCUMENTS

| | | | |
|---|---|---|---|
| 2,900,973 | 8/1959 | Diehr | 124/23.1 |
| 3,814,075 | 6/1974 | Hoyt, Jr. | 124/23.1 |
| 3,921,598 | 11/1975 | Helmick | 124/23.1 |
| 4,078,538 | 3/1978 | Shepley | 124/25.6 |
| 4,178,905 | 12/1979 | Groner | 124/25.6 |
| 4,333,443 | 6/1982 | Roelle | 124/25.6 |
| 4,336,786 | 6/1982 | Mannon et al. | 124/23.1 |
| 4,440,142 | 4/1984 | Simonds | 124/25.6 |
| 4,546,754 | 10/1985 | Smith | 124/86 |
| 4,644,929 | 2/1987 | Peck | 124/23.1 |
| 4,674,468 | 6/1987 | Izuta | 124/23.1 |
| 4,733,648 | 3/1988 | Martin | 124/86 |
| 4,781,167 | 11/1988 | Martin | 124/25.6 |
| 4,909,231 | 3/1990 | Larson | 124/23.1 |
| 4,926,833 | 5/1990 | Darlington | 124/23.1 |
| 4,957,094 | 9/1990 | Pickering et al. | 124/24.1 |
| 4,995,373 | 2/1991 | Mussack | 124/25.6 |
| 5,025,774 | 6/1991 | Martin | 124/89 |
| 5,307,787 | 5/1994 | LaBorde et al. | 124/25.6 |
| 5,331,941 | 7/1994 | Schaffer | 124/44.5 |
| 5,381,777 | 1/1995 | Mitchell et al. | 124/25.6 |
| 5,464,001 | 11/1995 | Peck | 124/25.6 |
| 5,487,373 | 1/1996 | Smith | 124/23.1 |
| 5,499,618 | 3/1996 | Thompson | 124/25.6 |
| 5,507,270 | 4/1996 | Smith | 124/23.1 |

*Primary Examiner*—John A. Ricci

[57] ABSTRACT

A compound archery bow has power cable adjusters operable to laterally adjust the power cable to minimize canting of the cam assemblies and adjust the effective length of the power cable to vary the timing of the cam assembly connected to the power cable. Limb pocket assemblies connect the flexible limbs to a riser with a compression clamping force. Opposing side plates are held in compression relation with the limb end with bolts turned down tight into a base supporting the limb end. The compression connection between the limb pocket assembly maintains the limb in a center line alignment with the vertical plane of the bow string and riser.

43 Claims, 10 Drawing Sheets

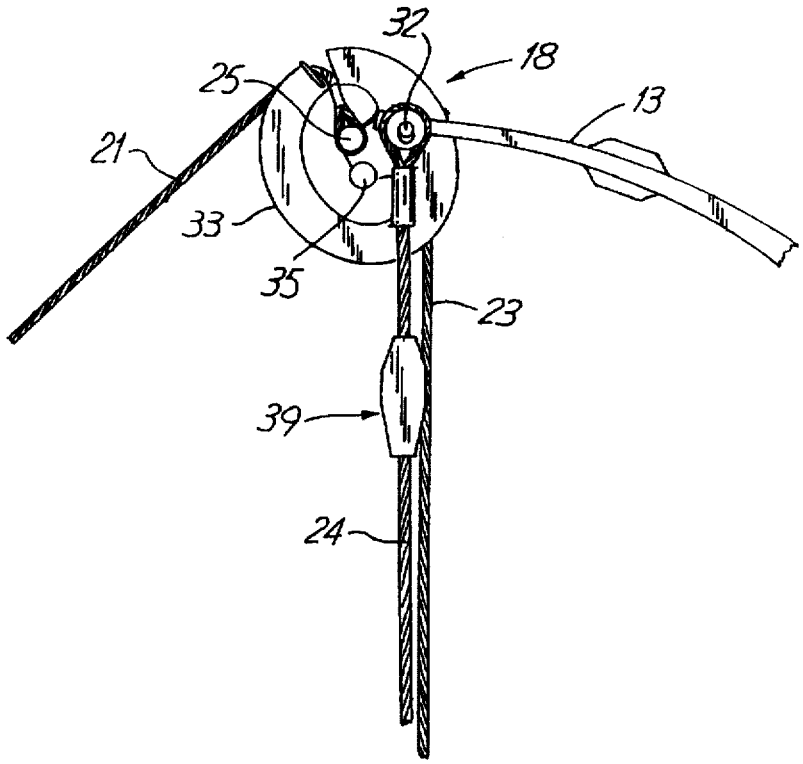
Fig. 7
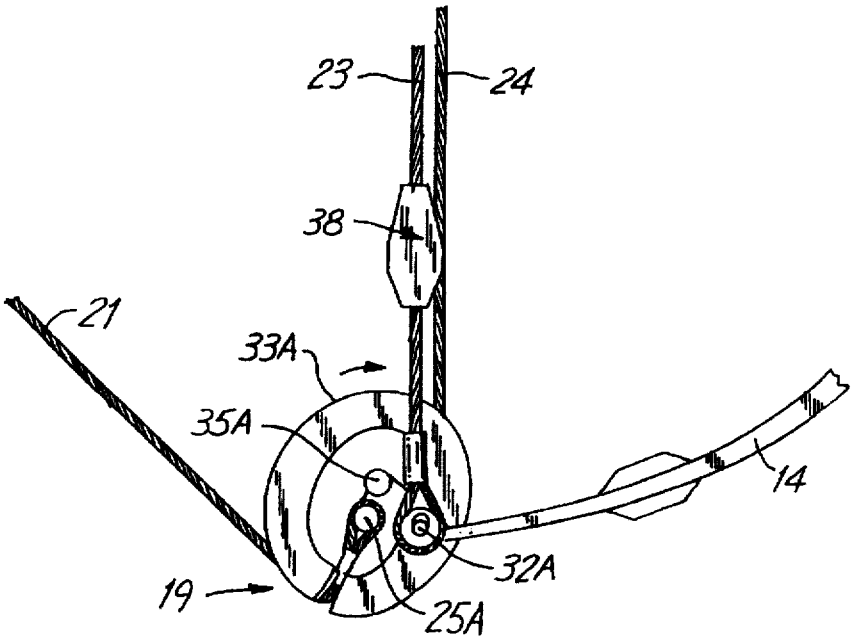

CABLE ADJUSTER AND LIMB POCKET ASSEMBLY FOR COMPOUND BOW

FIELD OF THE INVENTION

The invention relates to a compound bow having flexible limbs attached to opposite ends of a riser with connectors. Cam assemblies mounted on the outer ends of the limbs accommodate a bow string and power cables. Adjusters connected to the power cables provide lateral adjustment of the power cables to equalize forces at the outer ends of the limbs and adjust the tension of the power cables and timing of the cam assemblies. The connectors maintain the alignment of the limbs on the riser.

BACKGROUND OF THE INVENTION

Compound archery bows have bow strings used to propel light weight arrows toward a target with substantial force and power. These bows have flexible limbs secured to opposite ends of a riser. Cables extended over and attached to eccentric wheels rotatably mounted on opposite ends of the limbs are connected to each limb opposite the wheels. When the bow string is being drawn, the draw force applied to the bow increases to a maximum draw force and reduces to a lower draw force at the full draw position. Maximum potential energy is stored in the limbs without requiring maximum force to be applied to the bow string. This allows the archer to attain an accurate arrow aim on the target before release of the arrow. Canting and twisting of the limbs due to unequal forces on the limbs causes the bow string to laterally move relative to the arrow rest which detracts from the accuracy of the flight of the arrow. Examples of compound archery bows are disclosed by D. J. Martin in U.S. Pat. No. 4,733,648 and G. Simonds in U.S. Pat. No. 4,440,142. Martin's compound archery bow has anchors connecting the cables with the ends of the limbs for adjusting the length of the cables. Simonds' compound bow includes a cable length adjuster comprising discs cradled in bride cables connected to the bow limb tips. Each disc has a plurality of slots or notches having different depths accommodating a cable end. These compound archery bows do not have structures that prevent canting or twisting of the limbs. Compound archery bows include limb pockets for mounting the limbs on the opposite ends of the riser of the bow. Extra parts such as rockers, half round or ball bearings located in the limb pocket are used to maintain the alignment of the limbs on the riser. Often times substantial vibration of the bow occurs when the bow string is released. Vibrations in the limbs can loosen the limb bolts and mis-align the limbs. Separate set screws are used to lock the limb bolts to prevent them from coming loose. The sides of the pockets are fixed to the riser and cannot be laterally adjusted to place the limb under compression.

SUMMARY OF THE INVENTION

The invention concerns a compound archery bow equipped with cable adjusters that minimize twisting and canting of the outer ends of the limbs including the shaft supporting eccentric cam assemblies. The adjusters are operable to adjust the effective lengths of the cables relative to the limbs to equalize forces at the outer ends of the limbs to prevent canting and twisting of the limbs. The adjusters also are used to equalize cable lengths to adjust the timing or angular orientation of the cam assemblies so that the cam assemblies recover simultaneously to minimize longitudinal movements of the bow string.

A preferred form of the compound archery bow has a riser and outwardly-extended flexible limbs mounted on opposite ends of the riser. Eccentric cam assemblies mounted on axles are located adjacent the outer ends of the limbs. Holders or holes in the outer ends of the limbs accommodating the axle are mounted on the limbs. The cam assemblies support a bow string and a pair of power cables. A first cable is trained about an eccentric cam of one of the cam assemblies. This cable is anchored with a cable adjuster and yoke cables to the axle supporting the other cam assembly. A second cable is trained about an eccentric cam of the other cam assembly and anchored with a cable adjuster to the axle supporting the opposite cam assembly. Each adjuster has a body with divergent passages accommodating the yoke cables that are connected to an axle of a cam assembly. The body has slots aligned with and open to the passages to allow portions of the yoke cables to be moved out of the passages and into the slots. Set screws threaded into the body engage the yoke cables and force the cables into the slots thereby adjusting the effective lengths of the cables. Both set screws are used to adjust the overall length of the cable. This also adjusts the angular relationship of the eccentric cam assembly opposite the adjuster. The opposite adjuster is used to adjust the angular relationship of the other eccentric cam. The eccentric cam assemblies are adjusted to change the effective length of the power cables to synchronize the operation of the eccentric cam assemblies. When one of the set screws is adjusted, the lateral loads on the outer end of the limb are adjusted to a position wherein the forces on the opposite ends of the axle of a cam assembly are substantially equalized when the bow string is at maximum draw or in static position. This prevents the axle from canting or twisting and applying twisting forces on the limb which deters arrow accuracy.

The invention includes a limb pocket assembly having a generally rectangular pocket that accommodates the inner end of a limb so as to position and maintain the center line of the limb in alignment with the bow string and riser of the compound bow. Extra parts such as rockers and bearings to maintain the alignment of the limb with the bow string and riser are eliminated. In addition to maintaining the center line of the limb in alignment with the bow string, the limb pocket assembly also substantially reduces vibrations when the bow string is released. Accordingly, separate set screws or other assemblies are not needed to lock and prevent the limb bolt from loosening due to vibrations.

The limb pocket assembly has a base located on the outer end of the riser. The base has a generally flat outer surface that supports the inner end of the limb. The base has a width that is less than the width of the inner end of the limb. A fastener connects the inner end of the limb to the base and the riser. A first plate connected to the base has an inside surface engageable with the outside surface inner end of the limb. A second plate connected to the base opposite from the first plate has an inside surface engageable with the other outside surface of the inner end of the limb. A plurality of bolts used to attach the first and second plates to the opposite sides of the base can be tightened to laterally adjust the plates and place the outside surfaces of the inner end of the limb under compressions. An outwardly-directed lip on the end of the base functions as a stop that is engageable with the limb to locate the base of the limb adjacent the first and second plates.

DESCRIPTION OF DRAWINGS

FIG. 7 is a fragmentary left side elevational view of the compound bow of FIG. 1 with the bow string in the full draw position;

DESCRIPTION OF PREFERRED EMBODIMENT

Figure 1:
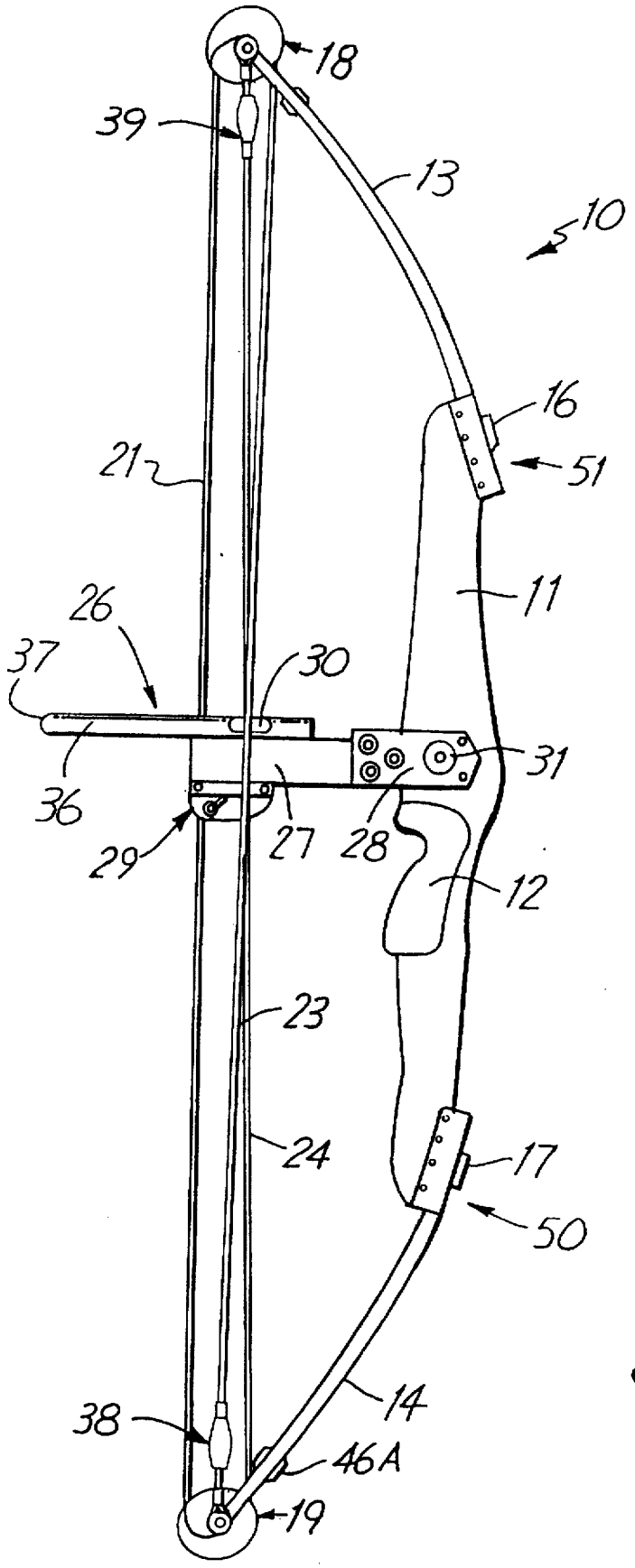
FIG. 1 is a side elevational view of a compound bow equipped with the cable lateral position and tension adjusters of the invention.
Figure 2:
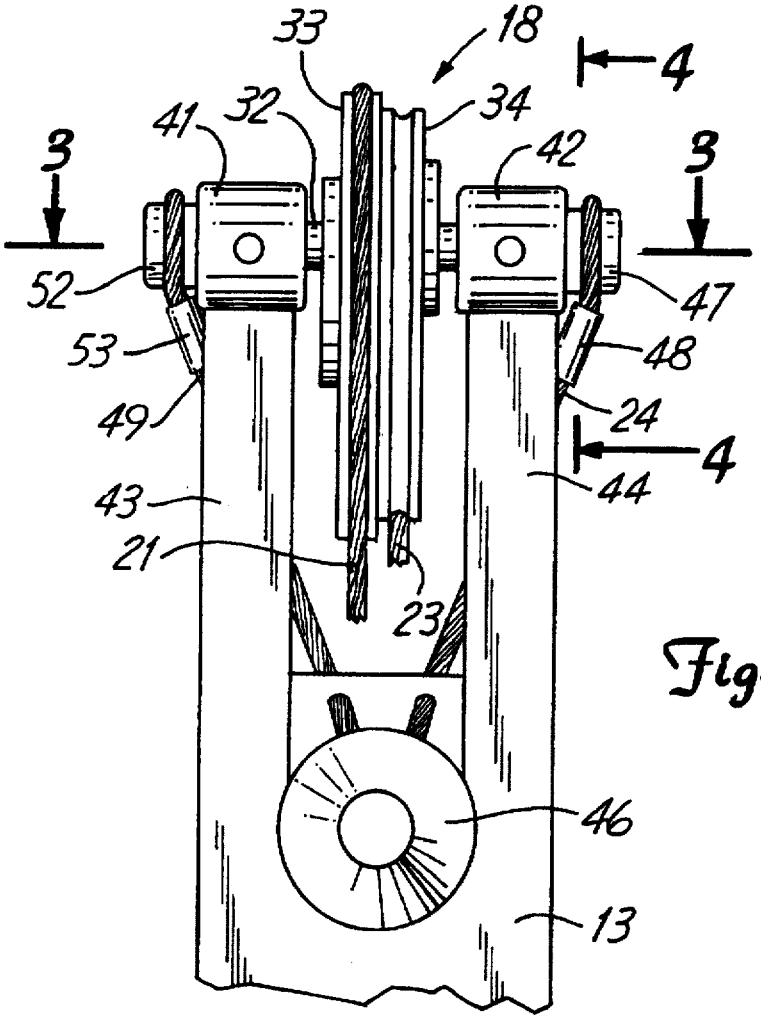
FIG. 2 is an enlarged plan view of an outer end of the bow of FIG. 1.
Figure 3:
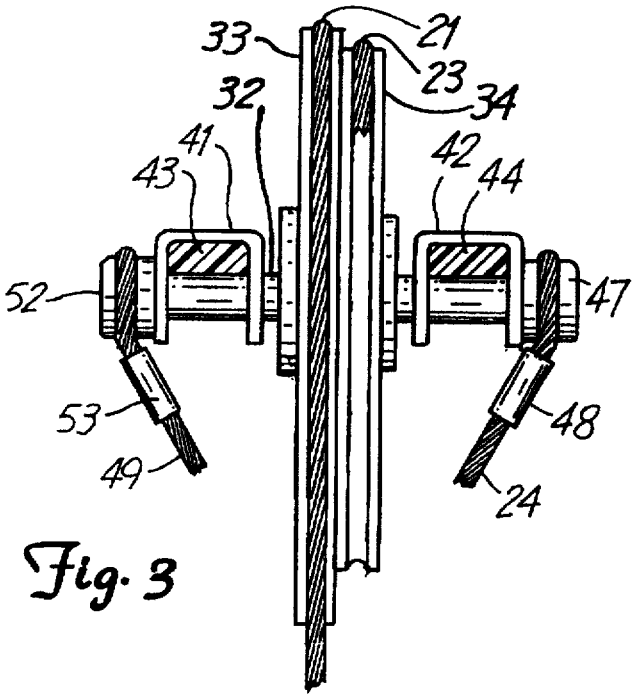
FIG. 3 is a sectional view taken along the line 3—3 of FIG. 2.
Figure 4:
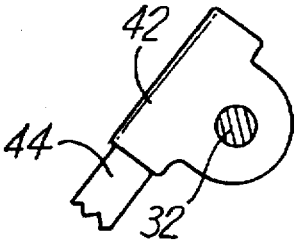
FIG. 4 is a sectional view taken along the line 4—4 of FIG. 2.
Figure 5:
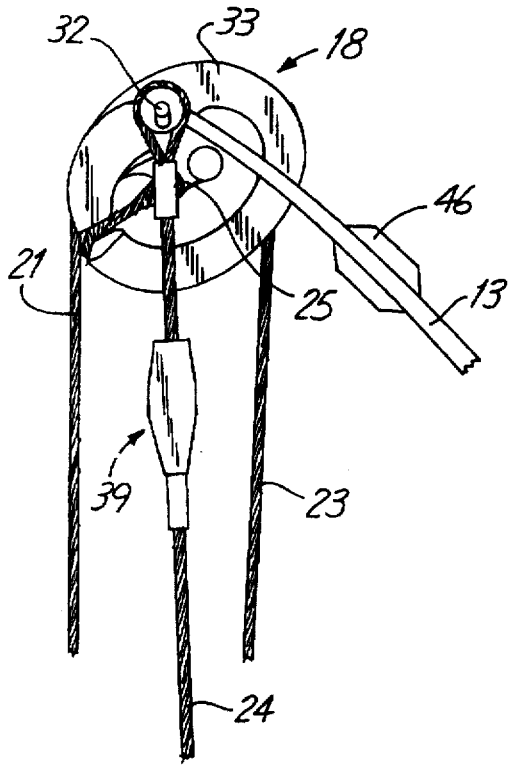
FIG. 5 is an enlarged foreshortened left side elevational view of the compound bow of FIG. 1 with the bow string in the released position.
Figure 5:
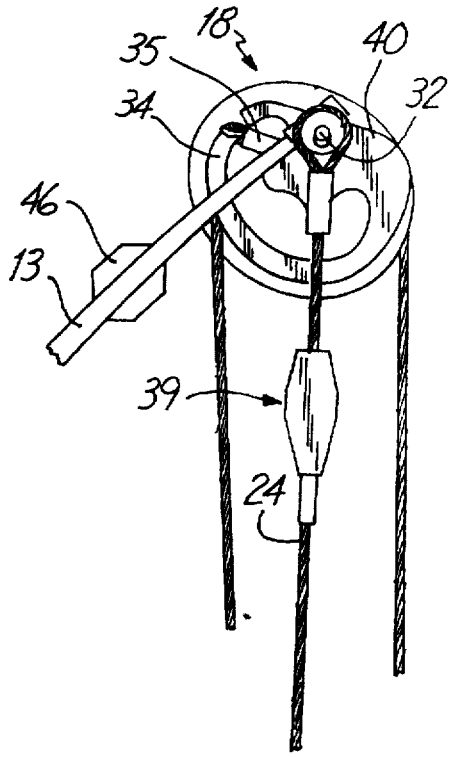
Figure 5:
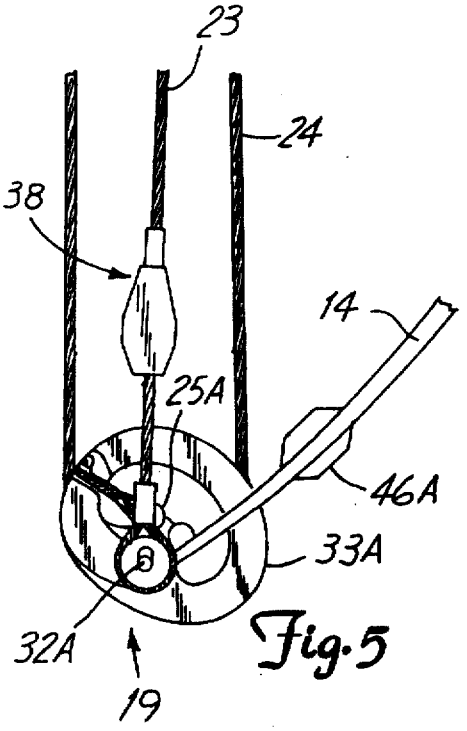
Figure 6:
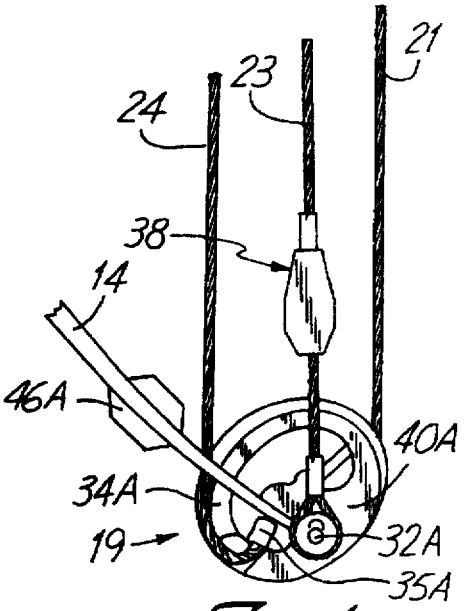
FIG. 6 is an enlarged fragmentary right side elevational view of the compound bow of FIG. 1 with the bow string in the released position.

Referring to FIG. 1 of the drawings, there is shown a compound bow, indicated generally at 10, used by an archer to shoot relatively short and light-weight arrows at designated targets. Bow 10 has an elongated body or riser 11 having a hand grip 12 immediately below the center of riser 11. Riser 11 has a strong, light-weight metal, such as magnesium alloy, plastic or wood construction having mounts 50 and 51 on opposite ends thereof to accommodate arcuate-shaped flexible upper and lower limbs 13 and 14. Bolt connectors 16 and 17 secure the inner ends of limbs 13 and 14 to mounts 50 and 51 as herein described. Limbs 13 and 14 are generally flat leaf springs having recurved configurations. Other types of limbs without recurved shapes can be used. Limbs 13 and 14 are preferably made of unidirectional reinforced strands of plastic and other spring-like materials. An upper wheel or cam assembly 18 is mounted on the outer end of limb 13. A similar lower wheel or cam assembly 19 is mounted on the outer end of limb 14. As seen in FIG. 2, cam assembly 18 has an eccentric bow string cam 33 located adjacent an eccentric power cable cam 34. As shown in FIGS. 5 and 6, cam 33 has an oval or elliptical outer edge with a groove accommodating bow string 21. The end of bow string 21 extends inwardly from the outer edge and is attached to anchor 25. Bow string 21 extends around cam 33 about 350 degrees beginning at the major axis of cam 33 adjacent bow string 21 and extending around cam 33 to a point adjacent the major axis adjacent the bow string. The major axis of cam 33 is generally normal to the longitudinal axis of the outer end of limb 13. Cam 33A has its major axis generally normal to the longitudinal axis of the outer end of limb 14. Cams 33 and 33A concurrently turn on axles 32 and 32A so that the timing of the cams relative to each other is equal. This results in equal forces on limbs 13 and 14 when the bow string 21 is moved to the full draw position.

Figure 8:
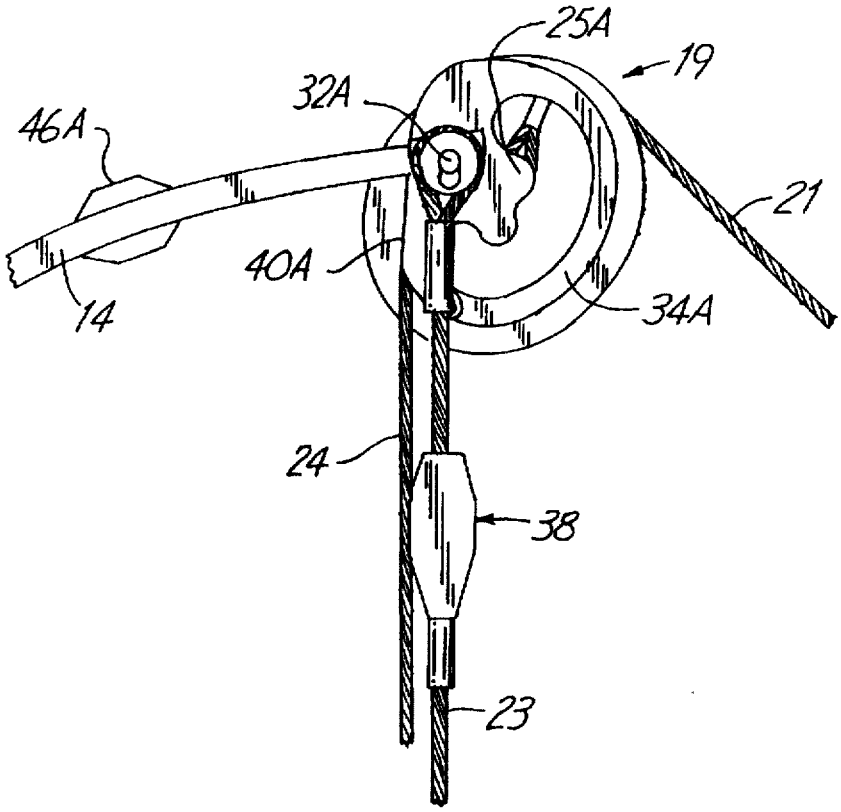
FIG. 8 is a fragmentary right side elevational view of the compound bow of FIG. 1 with the bow string in the full draw position.
Figure 8:
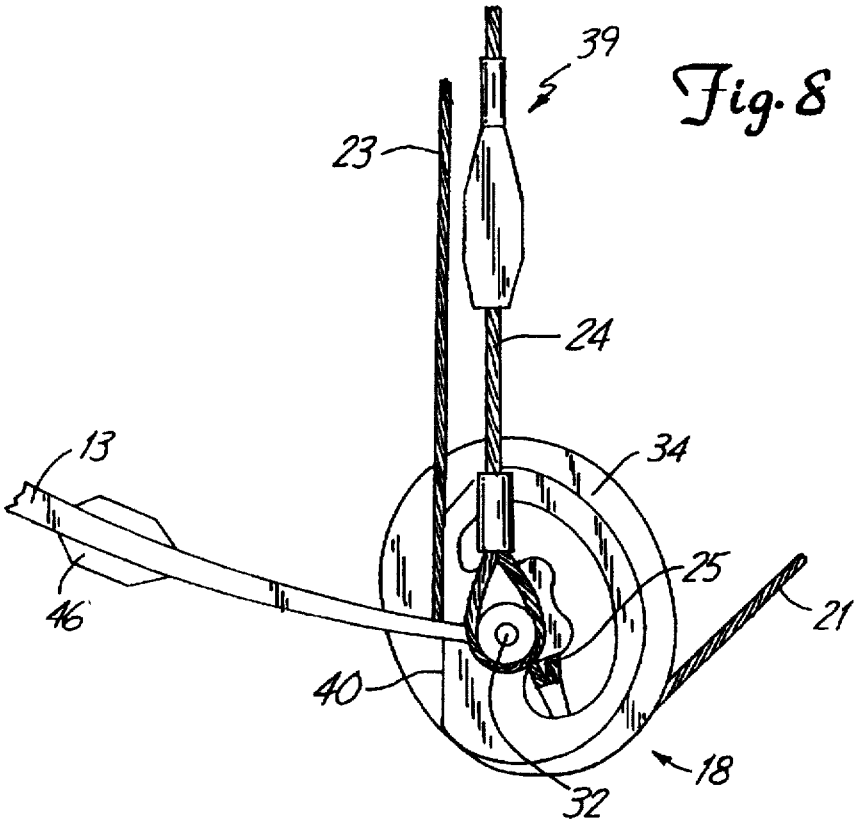

Cam 34 has an outer oval or elliptical outer edge that follows the elliptical shape of the outer edge of cam 33. The outer edge of cam 34 has a flat section 40 located adjacent axle 32 and an outer groove accommodating cable 23. The end of cable 23 is attached to an anchor 35 located opposite anchor 25. When the bow string 21 is moved to the full draw position, cable 23 winds onto cam 34, as seen in FIG. 8, and on the flat portion 40. Cable 24 winds onto cam 34A and the flat portion 40A in timed relation with cable 23. This applied equal forces on the limbs 13 and 14 and prevents longitudinal movement of the bow string 21 when it is released. The cable adjusters 38 and 39 are used to adjust the timing of the cam assemblies 18 and 19, as hereinafter described. Cams 33 and 34 are located off-center secured to the center portion of an axle or rod 32. Holders 41 and 42 mounted on outer ends of bifurcated portions 43 and 44 of limb 13 accommodate shaft 32. Cam assembly 18 is located in the space between the bifurcated portions of limb 13. A button or bolt assembly 46 is attached to limb 13 at the base of the space between limb portions 43 and 44 to minimize the breaking and cracking of the limb end portions 43 and 44. Bow string cam 33 and power cable cam 34 are eccentrically mounted cam wheels or pulleys. They can have the eccentric shapes of the cam wheels as shown by R. F. Darlington in U.S. Pat. No. 4,926,833. Other eccentric shapes of cam wheels can be used for bow string cam 33 and power cable cam 34. Cam assembly 19 has the same size and structure as cam assembly 18. The parts of cam assembly 19 that corresponds to the parts of cam assembly 18 have the same reference numbers with suffix A.

A bow string 21 is trained about bow string cam 33. A first power cable 23 is trained about power cable eccentric cam 34. A second power cable 24 is trained about the power cable eccentric cam of cam assembly 19. In use, cam assemblies 18 and 19 rotate in opposite directions, as shown by the arrows in FIG. 7, to increase the pull on bow string 21 from its initial tension to about 90 pounds and then reduce the tension to 35 pounds prior to the release of the arrow. Once the arrow is released, cam assemblies 18 and 19 rotate back to increase the tension to 90 pounds thereby imparting substantial thrust to the released arrow. Bow string 21 can be subjected to other amounts of tension or operational pull force.

Power cable 23 is connected to the axle supporting cam assembly 19. A first power cable adjuster 38 connects cable 23 with the yoke cables that extend to the opposite outer ends of the axle of cam assembly 19. As seen in FIG. 5, cable 24 extends through a second power cable adjuster 39 and is attached to a cap 47 with a clamp 48. Cap 47 is mounted on an end of axle 32. A short cable 49 is mounted on a cap 52 located on the opposite end of axle 32 and is retained thereon with a clamp 53. Cable 49 and the outer end of cable 24 are yoke cables connected to opposite ends of axle 32 and adjuster 39. Caps 47 and 52 maintain the axle in assembled relation with holders 41 and 42. Cable 49 extends through power cable adjuster 39 and is secured to cable 24 with a clamp 54. Clamp 54 is located adjacent the inward side of power cable adjuster 39.

Returning to FIG. 1, an overdraw apparatus, indicated generally at 26, is attached to the mid-portion of riser 11 above hand grip 12 and extends rearwardly adjacent bow string 21. Overdraw apparatus 26 is disclosed in U.S. Pat. No. 5,331,941, which is incorporated herein by reference. Overdraw apparatus 26 has an elongated generally rectangular bar or support member 27 secured by connector plate 28 to riser 11 with a bolt 31. An arrow rest 29 is secured to a lower portion of support member 27. An elongated rearwardly-directed cable guard rod 36 is secured to the upper portion of support member 27. Rod 36 has a hemispherical-shaped end 37 and a generally cylindrical shape. A slide 30 slideably located adjacent one side of rod 36 accommodates crossed power cables 23 and 24 and laterally positions cables 23 and 24 relative to bow string 21 and the cam assemblies 18 and 19.

Figure 9:
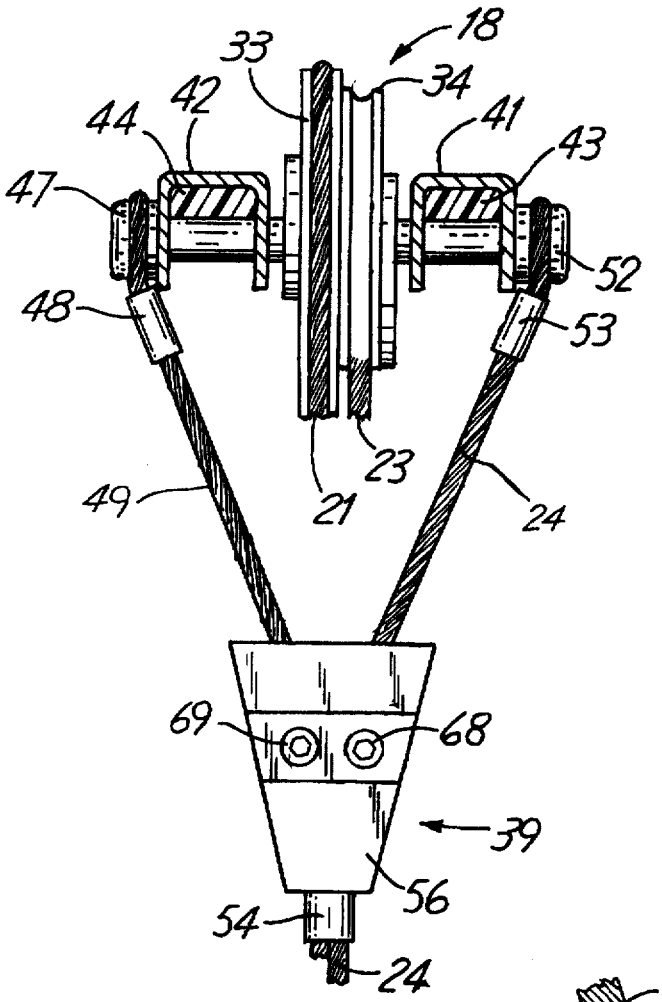
FIG. 9 is a rear plan view, partly sectioned, of an outer end of the bow of FIG. 1.
Figure 10:
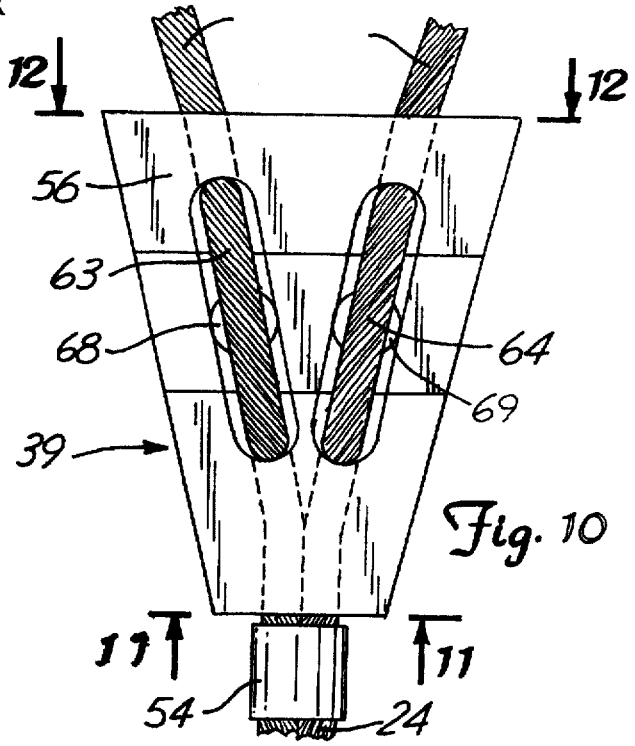
FIG. 10 is an enlarged bottom view of the cable adjuster.
Figure 11:
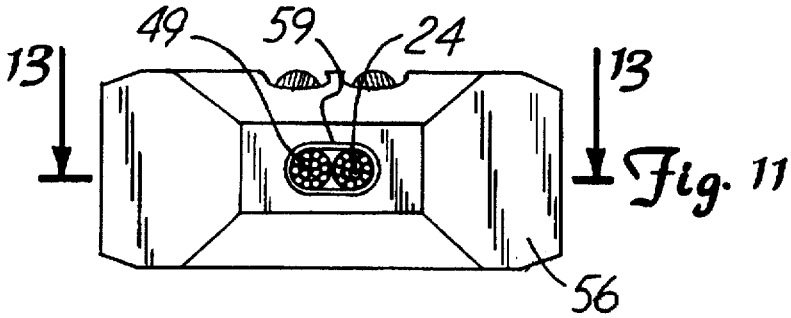
FIG. 11 is a sectional view taken along the line 11—11 of FIG. 10.
Figure 12:
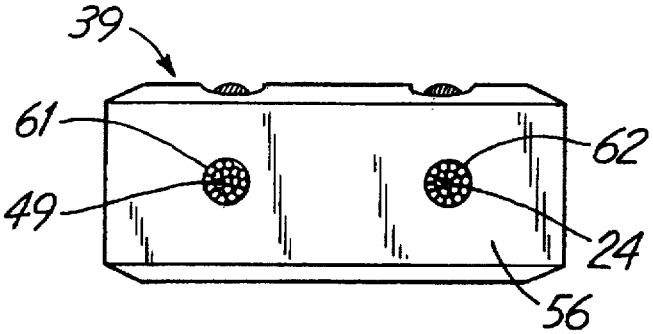
FIG. 12 is a sectional view taken along the line 12—12 of FIG. 10.
Figure 13:
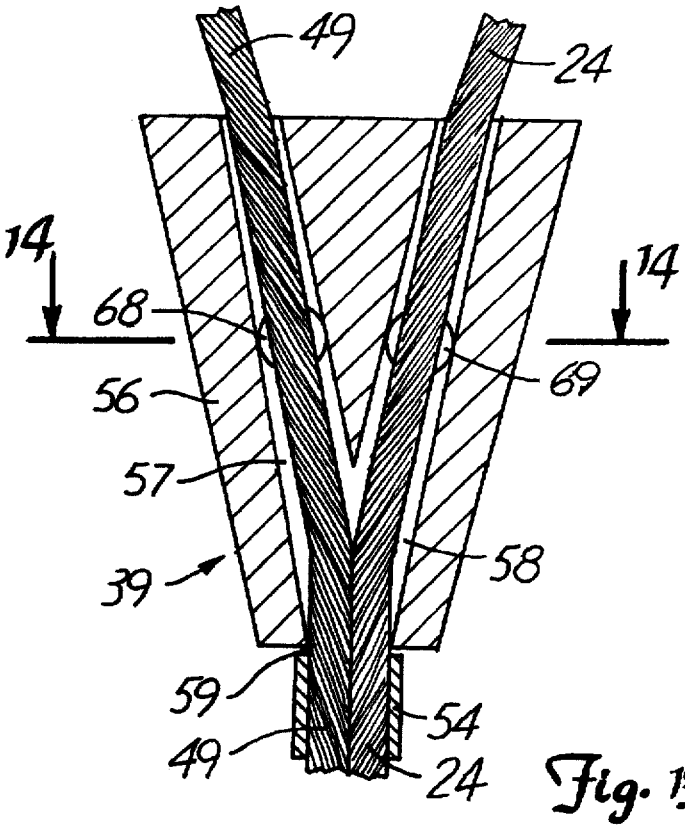
FIG. 13 is a sectional view taken along the line 13—13 of FIG. 11.
Figure 14:
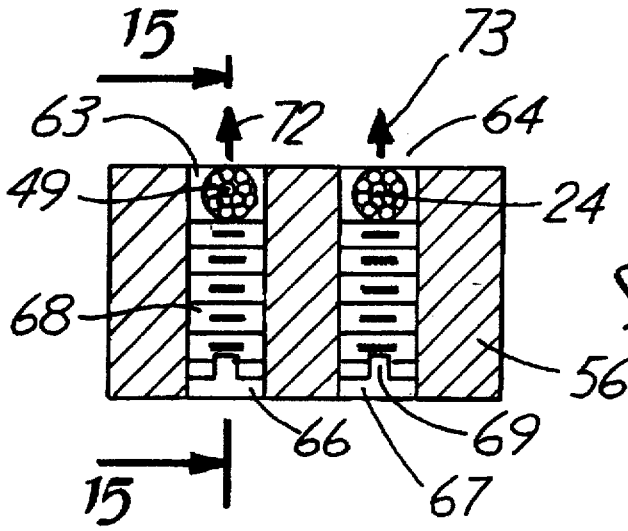
FIG. 14 is a sectional view taken along the line 14—14 of FIG. 13.
Figure 15:
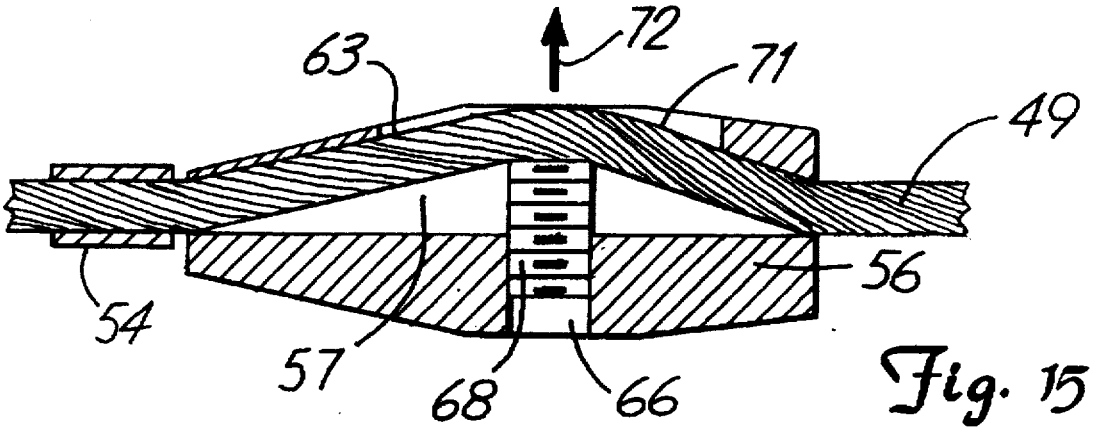
FIG. 15 is a sectional view taken along the line 15—15 of FIG. 14.

Referring to FIGS. 9–15, there is shown power cable adjuster 39 mounted on power cable 24 and auxiliary cable 49 adjacent clamp 54. Adjuster 38 has the same structure as adjuster 39. Power-cable adjuster 39 has a generally trapezoidal-shaped housing or body 56 having a pair of divergent passages 57 and 58 that accommodate portions of cables 24 and 49. The angles of passages 57 and 58 are in longitudinal alignment with the angular relationship of yoke cables 24 and 49 leading from opposite ends of axle 32. Cables 24 and 49 extend through passages 57 and 58, as seen in FIG. 9, and are clamped together with clamp 54 adjacent the inward end of adjuster 39. Passages 57 and 58 converge to a common opening 59 adjacent clamp 54. The opposite ends of passages 57 and 58 have laterally spaced openings 61 and 62. The back side of body 56 has elongated diverging slots 63 and 64 that are aligned with and open to mid portions of passages 57 and 58. Slots 63 and 64 provide lateral spaces adjacent passages 57 and 58 that accommodate portions of the cables located in the passages. The mid section of body 56 has a pair of threaded bores 66 and 67 aligned with the mid portions of passages 57 and 58, and slots 63 and 64. Set screws 68 and 69 are threaded into bores 66 and 67 and engage mid portions of yoke cables 24 and 49, respectively to move the mid portions of cables into slots 63 and 64 thereby changing the effective lengths of these cables. Other types of structures, such as wedges, can be used to force and hold the cable portions into slots 63 and 64. Set screws 68 and 69 are separately adjustable to change the effective lengths of the yoke cables 24 and 49 thereby changing the working length of power cable 24 and angular orientation of cam assembly 19. When both set screws 68 and 69 are adjusted, the length and tension on cable 24 is adjusted thereby adjusting the timing of cam assembly 19. The timing of cam assembly 19 changes by adjusting the angular orientation of cam assembly 16 relative to the line of the bow string 21. Both adjusters 38 and 39 are used to synchronize the timing operation of the cam assemblies 18 and 19 so that they recover at the same time, or simultaneously, to minimize longitudinal movement of the bow string during the draw and release of bow string 21. When one of the set screws 68 or 69 is adjusted, the lateral position of power cable 24 is adjusted to substantially equalize the forces on the opposite ends of axle 32 when the bow string 21 is at maximum pull. This prevents axle 32 and cam assembly 19 from canting or twisting and applying twisting and torsional forces on limb 13. Twisting of plastic limbs having unidirectional reinforcing strands is detrimental or pernicious because the forces are at an angle to the reinforcing strands. Set screws 68 and 69, when threaded into bores 66 and 67, move the yoke cable portions in engagement with set screws 68 and 69 into slots 63 and 64, as shown in FIG. 15, thereby applying outwardly-directed forces, as indicated by arrows 72 and 73 to cables 24 and 49 and thereby change the effective lengths of the yoke cable portions.

The set screws 68 and 69 are selectively adjusted to change lateral line of force of the power cable relative to the outer end of the limb and cam assembly mounted thereon and to adjust the effective length of the power cable to adjust the timing or angular orientation of cam assembly The opposite cable 23 accommodates adjuster 38, as seen in FIG. 1. Adjuster 38 is used to change the effective length of cable 23, as well as adjust the lateral position of power cable 23 relative to its associated cam assembly. Adjusters 38 and 39 also provide the archer with cam assembly adjustments so that there is simultaneous timing of the cam assemblies 18 and 19 on opposite ends of the bow limbs during the release of the arrow from bow string 21.

Figure 16:
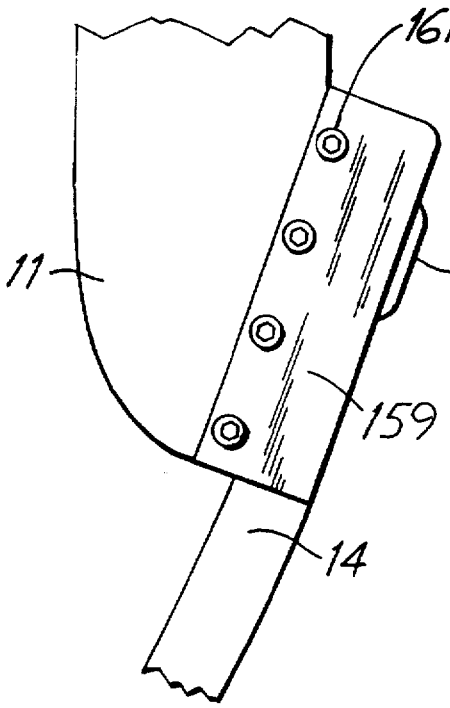
FIG. 16 is a side view of a connector to secure a limb to the riser.

Referring to FIGS. 1 and 16, limb pocket assembly 50 is attached to the lower end of riser 11 and accommodates the inner end of lower limb 14. An identical limb pocket assembly, indicated generally at 51, attaches the inner end of upper limb 13 to the upper end of riser 11. Limb pocket assemblies 50 and 51 are adjustable to provide a compressive force, as indicated by arrows 166 in FIGS. 17 and 19, to hold the inner ends of limbs 13 and 14 in clamping compressive relationship with the outer ends of riser 11. This maintains the center line of limbs 13 and 14 in alignment with bow string 21 and minimizes vibrations of limbs 13 and 14 relative to riser 11.

Figure 18:
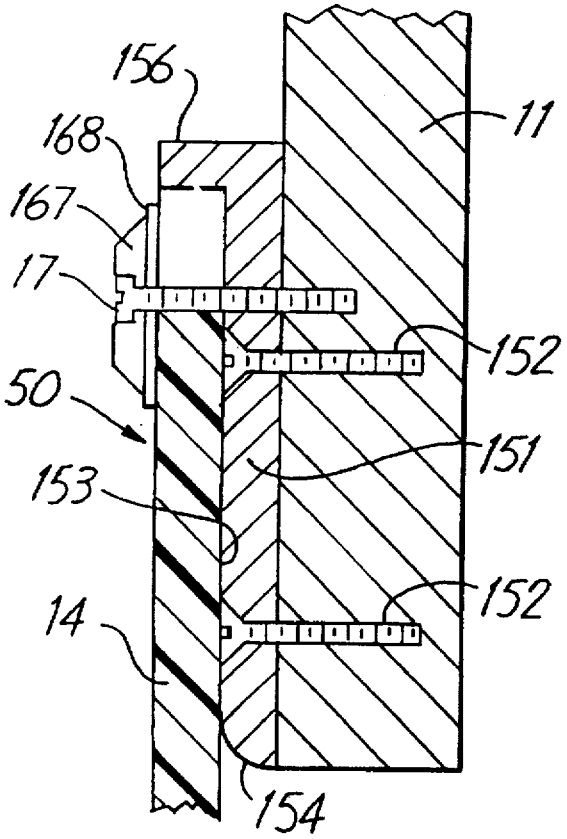
FIG. 18 is a sectional view taken along the line 18—18 of FIG. 17.
Figure 19:
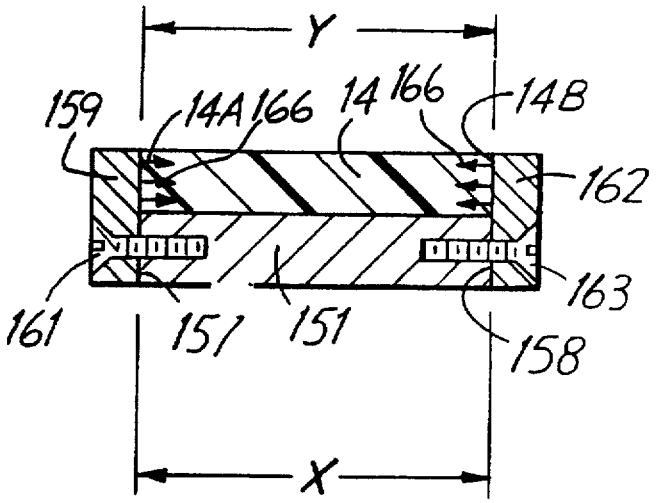
FIG. 19 is a sectional view taken along the line 19—19 of FIG. 17.

Referring to FIGS. 18 and 19, limb pocket assembly 50 has a base 151 attached with screws 152 to the outer end of riser 11. Other types of fasteners can be used to secure base 151 to riser 11. Limb pocket assembly 50 is used to attach limb 14 to the lower end of riser 11. Limb pocket assembly 51 attaching limb 13 to the upper end of riser 11 is identical to limb pocket assembly 50. The following description is limited to limb pocket assembly 50. Base 151 of limb pocket assembly 50 has a generally flat outer surface 153 that terminates at a convex outer end 154, as seen in FIG. 14. The upper end of base 151 has an outwardly directed lip 156 which serves as a stop or positioner for the inner end of limb 14. Base 151 has side faces 157 and 158 that extend linearly throughout their length. Side faces 157 and 158 are flat and parallel to each other and are located on opposite sides of base 151. As shown in FIG. 19, the width X of base 151 between faces 157 and 158 is 44 mm. Other widths of base 151 can be used with limb pocket assembly 50. Base 151 can also be machined directly on the outer end of riser 11 (not shown).

Limb 14 is located on the outer surface 153 of base 151 with the opposite sides 14A and 14B located in general alignment with sides faces 157 and 158 of limb pocket assembly 50. As shown in FIG. 19, limb 14 has a transverse dimension of Y or 45 mm which is slightly larger than the transverse dimension of the width of base 151. Other widths of limb 14 can be used with limb pocket assembly 50 in accordance with the width of the base 151.

Figure 17:
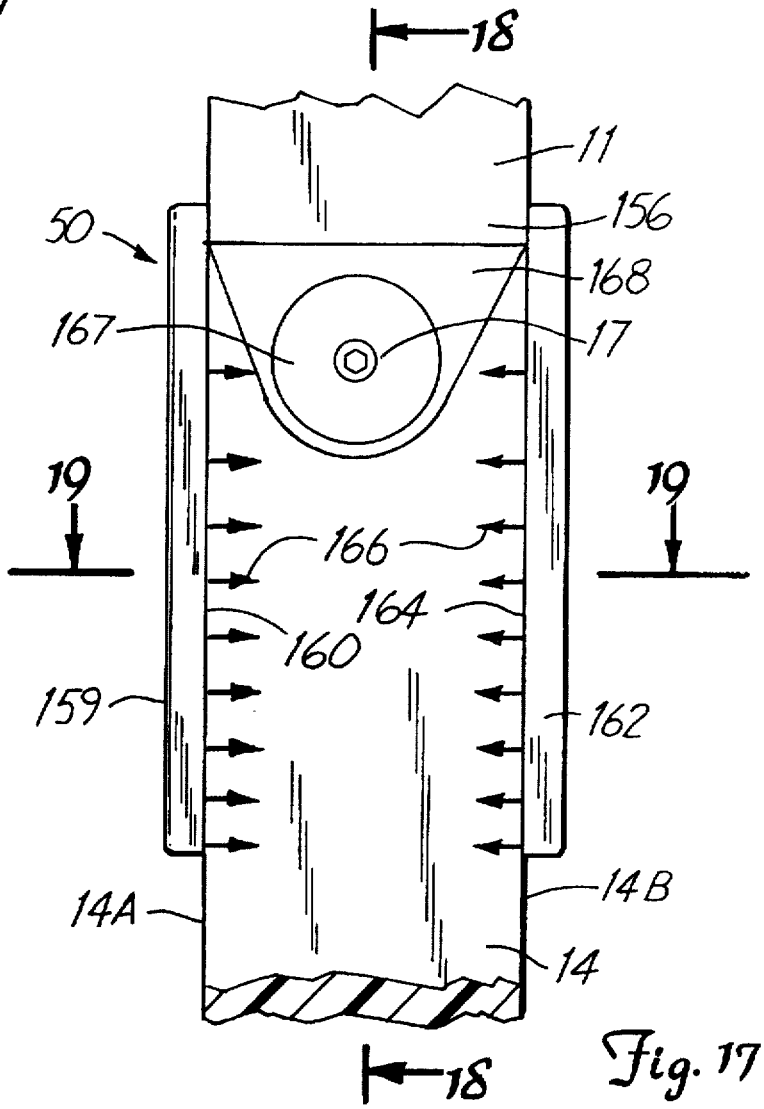
FIG. 17 is an enlarged plan view of the connector of FIG. 16.

As shown in FIG. 17*a* first side plate 159 having a generally flat inside surface 160 is secured to base 151 with a plurality of bolts 161. Inside surface 160 is located in surface engagement with flat side surface 14A of limb 14. A second side plate 162 has an inside flat linear surface 164 located in surface engagement with limb side surface 14B. A plurality of bolts 163 secure side plate 162 to base 151. As shown in FIGS. 17 and 18, limb bolt connector 17 holds a button 167 and washer 168 adjacent the outside surface of the inner end of limb 14. Button 167 and washer 168 function to minimize cracking and splitting of the inner end of limb 14.

To attach limb 14 to the lower end of riser 11, the inner end of limb 14 is located in the generally rectangular pocket of limb pocket assembly 50. The inside surface-of the inner end of limb 14 engages outer surfaces 153 of base 151. Opposite side surfaces 14A and 14B are located in surface engagement with surfaces 160 and 164 of side plates 159 and 162, respectively. Limb bolt 17 is threaded tightly into base 151 and riser 11 to hold button 167 and washer 168 adjacent the outside surface of the inner end of limb 14 and connect limb 14 to base 151 and riser 11. Button 167 and washer 168 minimize cracking and splitting of the outer end of limb 14. Bolts 161 and 163 are turned down tight laterally and adjust plates 159 and 152 to place the inner end of limb 14 under compression, as indicated by arrows 166 in FIGS. 17 and 19. The compression connection of side plates 159 and 162 to limb 14 holds limb 14 on the lower end of riser 11 with zero tolerance and maintains limb 14 in a center line alignment with the vertical plane of bow string 21 and riser 11. The tight compression between limb pocket assembly 50 and limb 14 substantially reduces the vibrations of limb 14 relative to riser 11 thereby minimizing the loosening of limb bolt connector 17. Limb 13 is attached to the upper end of riser 11 with limb pocket assembly 51 in substantially the same manner.

While there has been shown and described a preferred embodiment of the cable adjuster and limb pocket assembly for a compound bow of the invention, it is understood that changes in the structure, arrangement of structure and parts may be made by those skilled in the art without departing from the invention. The invention is defined in the following claims.

I claim:

1. A compound archery bow comprising: a riser having opposite ends, a first flexible limb having an outer end, connector means mounting the first flexible limb on one end of the riser, a second flexible limb having an outer end, connector means mounting the second flexible limb on the outer end of the riser, a first eccentric cam assembly, means mounting the first eccentric cam assembly on the outer end of the first flexible limb, a second eccentric cam assembly, means mounting the second eccentric cam assembly on the outer end of the second flexible limb, a bow string trained about and attached to the first and second cam assemblies, a first cable connected to one cam assembly, first means connecting the first cable to the outer end of the limb opposite the one cam assembly, a second cable connected to the other cam assembly, second means connecting the second cable to the outer end of the limb opposite the other cam assembly, said first and second means each having an adjuster means for laterally adjusting the location of the cable relative to the cam assembly on the outer end of the limb to minimize canting of the limb when draw force is applied to the bow string, said first and second means each having a pair of cables connected to a cam assembly, said adjuster means includes a body having passages extending through said body, said pair of cables extending through said passages, slot means in said body open to said passages for accommodating portions of said pair of cables, means mounted on the body engageable with the pair of cables in the passages operable to move said pair of cables into the slot means to selectively adjust the length of the pair of cables and adjust the lateral location of the one of the pair of cables relative to the cam assembly on the outer end of the limb.

2. The bow of claim 1 wherein: each connector means includes a base located on an outer end of the riser, a fastener connecting an inner end of the limb to the base thereby securing the limb to the riser, first plate means engageable with the inner end of the limb, second plate means engageable with the inner end of the limb opposite from the first plate means, said first and second plate means longitudinally aligning the inner end of the limb with the base, first means connecting the first plate means to the base, second means connecting the second plate means to the base and cooperating with the first means to place the inner end of the limb under compression, and stop means engageable with the limb to locate the inner end of the limb adjacent the first and second plate means.

3. The bow of claim 2 wherein: the base has a transverse dimension that is less than a transverse dimension of the inner end of the limb.

4. The bow of claim 2 wherein: the base has a generally flat outer surface and a convex outer end.

5. The bow of claim 2 wherein: the stop means is an outwardly directed lip located on an end of the base.

6. The bow of claim 2 wherein: the base has opposite side surfaces, the first plate means connected to one of the side surfaces, the second plate means connected to the other side surface.

7. The bow of claim 2 wherein: the first and second plate means each have an inside surface engageable with the inner end of the limb.

8. The bow of claim 2 wherein: the first plate means is located in a plane substantially parallel to a longitudinal plane of the second plate means.

9. The bow of claim 2 wherein: the first and second means include a plurality of threaded holes in the plate means and base, and bolts located in the holes to laterally adjust and retain the plate means in compression clamping relation with the inner end of the limb.

10. The bow of claim 2 including: means surrounding the fastener adjacent the limb to minimize cracking of the inner end of the limb.

11. A compound archery bow comprising: a riser having opposite ends, a first flexible limb having an outer end, connector means mounting the first flexible limb on one end of the riser, a second flexible limb having an outer end, connector means mounting the second flexible limb on the outer end of the riser, a first eccentric cam assembly, means mounting the first eccentric cam assembly on the outer end of the first flexible limb, a second eccentric cam assembly, means mounting the second eccentric cam assembly on the outer end of the second flexible limb, a bow string trained about and attached to the first and second cam assemblies, a first cable connected to one cam assembly, first means connecting the first cable to the outer end of the limb opposite the one cam assembly, a second cable connected to the other cam assembly, second means connecting the second cable to the outer end of the limb opposite the other cam assembly of said first and second means each having an adjuster means for laterally adjusting the location of the cable relative to the cam assembly on the outer end of the limb to minimize canting of the limb when draw force is applied to the bow string, each eccentric cam assembly has an axle having opposite ends, means mounting the axle on the outer ends of the limbs, said first and second means including a third and fourth cables, means connecting the third and fourth cables to the opposite ends of the axle, said adjuster means including a body having inwardly converging passages extended through the body, said third cable extended through one passage and the fourth cable extended through the other passage, means connecting third and fourth cables to the one of the first and second cables, a pair of slots in said body aligned with and open to said passages to accommodate portions of the third and fourth cables, a pair of adjustable means mounted on the body open to the passages and aligned with said slots engageable with said third and fourth cables operable to move said third and fourth cables into the slots to selectively adjust the length of the third and fourth cables and adjust the lateral location of the first and second cables relative to the cam assembly on the outer end of the limb to minimize canting of the cam assembly mounted on the limb.

12. The bow of claim 11 wherein: the body has an inner end and an outer end, said inner end having an opening to said two passages, said outer end having two laterally spaced openings for the third and fourth cables.

13. The bow of claim 11 wherein: said adjustable means comprise a pair of screws threaded into bores in the body, said screws being engageable with said third and fourth cables to selectively adjust the length of the third and fourth cables and adjust the lateral location of the one of the first and second cables relative to the cam assembly on the outer end of the limb to minimize canting of the cam assembly mounted on the limb.

14. The bow of claim 11 wherein: said third and fourth cables converge inwardly from the opposite ends of the axle, said converging passages in the body are linearly aligned with said third and fourth cables.

15. A cable tension and position adjuster for an archery bow used to shoot an arrow, said bow having a riser, flexible limbs mounted on the riser, eccentric cam assemblies mounted on the outer ends of the limbs, a bow string attached to the cam assemblies and power cables attached to the cam assemblies and yoke cables connecting the power cables to the outer ends of the limbs comprising: a body having passages to accommodate the yoke cables connecting one of the power cables to an outer end of a limb and slots aligned with and open to said passages, and means mounted on the body adapted to engage the yoke cables in said passages to selectively adjust the length of one of the power cables and adjust the lateral location of one of the power cables relative to the cam assembly on the outer end of the limb.

16. The adjuster of claim 15 wherein: the passages converge to a common opening in said body.

17. The adjuster of claim 15 wherein: the body has an inner end and an outer end, said inner end having an opening to said passages, said outer end having two lateral spaced openings for said yoke cables.

18. The adjuster of claim 15 wherein: said means mounted on the body adapted to engage the yoke cables comprising screws located in threaded bores in the body, said screws being engageable with said yoke cables to selectively adjust the length of one of the power cables and adjust the lateral location of one of the power cables relative to the cam assembly on the outer end of the limb.

19. An adjuster for adjusting the lateral location of a cable of an archery bow comprising: a body having opposite ends, first and second passages extended through said body and the opposite ends thereof, a first space aligned with the first passage, a second space aligned with and open to the second passage, first means mounted on the body operable to move a portion of a first cable from the first passage into the first space and retain the portion of the first cable therein, and a second means mounted on the body operable to move a portion of a second cable from the second passage into the second space and retain the portion of the second cable therein.

20. The adjuster of claim 19 wherein: said first and second passages converge toward each other.

21. The adjuster of claim 19 wherein: said body having an opening in one end thereof open to said first and second passages, and a pair of openings in the other end thereof, one of the pair of openings open to the first passage and the other of the pair of openings open to the second passage.

22. The adjuster of claim 19 wherein: the first space is a first slot open to the first passage, and the second space is a second slot open to the second passage.

23. The adjuster of claim 19 wherein: said first and second passages converge toward each other, said body having an opening in one end thereof open to said first and second passages, and a pair of openings in the other end thereof, one of the pair of openings open to the first passage and the other of the pair of openings open to the second passage.

24. The adjuster of claim 23 wherein: the first space is a slot open to the first passage and the second space is a second slot open to the second passage.

25. The adjuster of claim 19 wherein: the first means is a first member movably mounted on the body and engageable with the portion of the first cable adapted to move the portion of the first cable from the first passage into the first space, and the second means is a second member movably mounted on the body and engageable with the portion of the second cable adapted to move the portion of the second cable from the second passage into the second space.

26. The adjuster of claim 25 wherein: the first member and the second member are screws threaded into bores in the body.

27. A connector assembly for securing a limb to a riser of a compound bow comprising: a base located on an outer end of the riser, a fastener connecting an inner end of the limb to the base thereby securing the limb to the riser, first plate means engageable with the inner end of the limb, second plate means engageable with the inner end of the limb opposite from the first plate means, said first and second plate means longitudinally aligning the inner end of the limb with the base, first means connecting the first plate means to the base, second means connecting the second plate means to the base and cooperating with the first means to place the inner end of the limb under compression, and stop means engageable with the limb to locate the inner end of the limb adjacent the first and second plate means.

28. The assembly of claim 27 wherein: the base has a transverse dimension that is less than a transverse dimension of the inner end of the limb.

29. The assembly of claim 27 wherein: the base has a generally flat outer surface and a convex outer end.

30. The assembly of claim 27 wherein: the stop means is an outwardly directed lip located on an end of the base.

31. The assembly of claim 27 wherein: the base has opposite side surfaces, the first plate means connected to one of the side surfaces, the second plate means connected to the other side surface.

32. The assembly of claim 27 wherein: the first and second plate means each having an inside surface engageable with the inner end of the limb.

33. The assembly of claim 27 wherein: the first plate means is located in a plane substantially parallel to a longitudinal plane of the second plate means.

34. The assembly of claim 27 wherein: the first and second means include a plurality of threaded holes in the plate means and base, and bolts located in the holes to laterally adjust and retain the plate means in compression clamping relation with the inner end of the limb.

35. The assembly of claim 27 including: means surrounding the fastener adjacent the limb to minimize cracking of the inner end of the limb.

36. An assembly for connecting a limb to a riser of a compound bow comprising: a base having a generally flat outer surface for supporting an inner end of the limb and opposite side surfaces, the base attached to an outer end of the riser, a fastener connecting an inner end of the limb to the base thereby securing the limb to the riser, first means connected to a first side surface of the base and engageable with the inner end of the limb, second plate means connected to a second side surface of the base and engageable with the inner end of the limb, said first and second plate means longitudinally aligning the inner end of the limb with the base, stop means engageable with the limb to locate the inner end adjacent the first and second plate means, and means connecting the first plate means to the first side surface and the second plate means to the second side surface thereby placing the inner end of the limb under compression.

37. The assembly of claim 36 wherein: the base has a transverse dimension that is less than a transverse dimension of the inner end of the limb.

38. The assembly of claim 36 wherein: the first and second side surfaces are generally parallel to each other.

39. The assembly of claim 36 wherein: the stop means is an outwardly directed lip located on an end of the base.

40. The assembly of claim 36 wherein: the first and second plate means each have an inside surface engageable with the inner end of the limb.

41. The assembly of claim 36 wherein: the first plate means is located in a plane substantially parallel to a longitudinal plane of the second plate means.

42. The assembly of claim 36 wherein: the means connecting the first and second plate means to the first and second side surfaces includes a plurality of threaded holes in the plate means and base, and bolts located in the holes to retain the first and second plate means in compression clamping relation with the inner end of the limb.

43. The assembly of claim 36 including: means surrounding the fastener adjacent the limbs to minimize cracking of the inner end of the limb.

* * * * *